US009657611B2

(12) United States Patent
Doering et al.

(10) Patent No.: US 9,657,611 B2
(45) **Date of Patent: *May 23, 2017**

(54) VARIABLE DISPLACEMENT SOLENOID CONTROL

(71) Applicant: Ford Global Technologies, LLC, Dearborn, MI (US)

(72) Inventors: Jeffrey Allen Doering, Canton, MI (US); John Eric Rollinger, Troy, MI (US); Danny Zdravkovski, Macomb, MI (US); Karen Willard, Grosse Pointe Farms, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 32 days.

This patent is subject to a terminal disclaimer.

(21) Appl. No.: 14/595,880

(22) Filed: Jan. 13, 2015

(65) Prior Publication Data

US 2015/0122207 A1 May 7, 2015

Related U.S. Application Data

(63) Continuation of application No. 13/830,205, filed on Mar. 14, 2013, now Pat. No. 8,931,443.

(60) Provisional application No. 61/734,320, filed on Dec. 6, 2012.

(51) Int. Cl.

| | |
|---|---|
| ***F01L 9/04*** | (2006.01) |
| ***F01L 13/00*** | (2006.01) |
| ***F01L 1/04*** | (2006.01) |

(52) U.S. Cl.
CPC ..... *F01L 13/0042* (2013.01); *F01L 1/04* (2013.01); *F01L 13/0036* (2013.01); *F01L 2013/001* (2013.01); *F01L 2013/0052* (2013.01); *F01L 2820/031* (2013.01)

(58) Field of Classification Search
CPC ..... F01L 2013/0052
USPC ..... 123/90.11
See application file for complete search history.

(56) References Cited

U.S. PATENT DOCUMENTS

| | | | | |
|---|---|---|---|---|
| 6,832,583 | B2 | 12/2004 | Hayman | |
| 7,367,296 | B2 | 5/2008 | Degner et al. | |
| 8,931,443 | B2 * | 1/2015 | Doering | F01L 1/04 123/90.11 |
| 8,935,076 | B2 * | 1/2015 | Ide | 123/90.15 |
| 2010/0059015 | A1 * | 3/2010 | Surnilla | F01L 1/143 123/295 |
| 2011/0088643 | A1 * | 4/2011 | Gregor | F01L 13/0036 123/90.11 |
| 2011/0271918 | A1 * | 11/2011 | Nishikiori | B60K 6/445 123/90.1 |
| 2012/0016565 | A1 * | 1/2012 | Ide | F01L 1/267 701/102 |
| 2012/0138002 | A1 * | 6/2012 | Tsuzuki | F01L 1/185 123/90.18 |

* cited by examiner

*Primary Examiner* — Zelalem Eshete
(74) *Attorney, Agent, or Firm* — Julia Voutyras; McCoy Russell LLP

(57) ABSTRACT

Methods are provided for improved control of valve activation/deactivation mechanisms. One example method comprises, adjusting an electromechanical actuator to actuate cylinder valve deactivation/activation mechanisms. The actuator is operated at multiple levels based on engine operating conditions.

20 Claims, 6 Drawing Sheets

VARIABLE DISPLACEMENT SOLENOID CONTROL

CROSS REFERENCE TO RELATED APPLICATIONS

The present application is a continuation of U.S. patent application Ser. No. 13/830,205, entitled "VARIABLE DISPLACEMENT SOLENOID CONTROL," filed on Mar. 14, 2013, now U.S. Pat. No. 8,931,443, which claims priority to United States of America Provisional Patent Application No. 61/734,320, entitled "VARIABLE DISPLACEMENT SOLENOID CONTROL," filed on Dec. 6, 2012, the entire contents of each of which are incorporated herein by reference for all purposes.

BACKGROUND AND SUMMARY

Variable displacement engine (VDE) designs can provide increased fuel efficiency by deactivating cylinders during operation modes requiring decreased engine output. Such designs may also incorporate cam profile switching (CPS) to enable high, or low lift valve train modes which correspond to increased fuel efficiency during high and low engine speeds, respectively.

In CPS systems, a VDE design may be supported through a no-lift cam profile that deactivates cylinders based on engine output needs. As an example, U.S. Pat. No. 6,832,583 describes an engine valve train having multiple valve lift modes including cylinder deactivation. The described example utilizes high and low lift cams on the valve train which can be further modified so that low lift corresponds to a no-lift deactivation setting.

However, the inventors herein have recognized that CPS systems such those described in U.S. Pat. No. 6,832,583 may have a limited operating range during higher engine speeds, as they may be unable to robustly switch a cylinder deactivation device such as a solenoid within one engine cycle at higher engine speeds. Further, modifying a CPS system to include a cylinder deactivation device with faster switching capabilities may increase costs and decrease fuel efficiency, as cylinder deactivation devices with faster switching tend to be larger, more expensive, and less efficient.

In one example the above issue may be at least partly addressed by a method for an engine, comprising: adjusting an electromechanical actuator to actuate a cylinder valve adjustment mechanism (such as a VDE mechanism and/or a cam profile switching mechanism), including operating the actuator at a first level without a valve transition, operating the actuator at a second level without a valve transition in response to an increased potential for a valve transition, and operating the actuator at a third level inducing a valve transition, the second level between the first and third levels. In this way, by operating the actuator at selected levels during selected conditions, faster switching may be achieved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
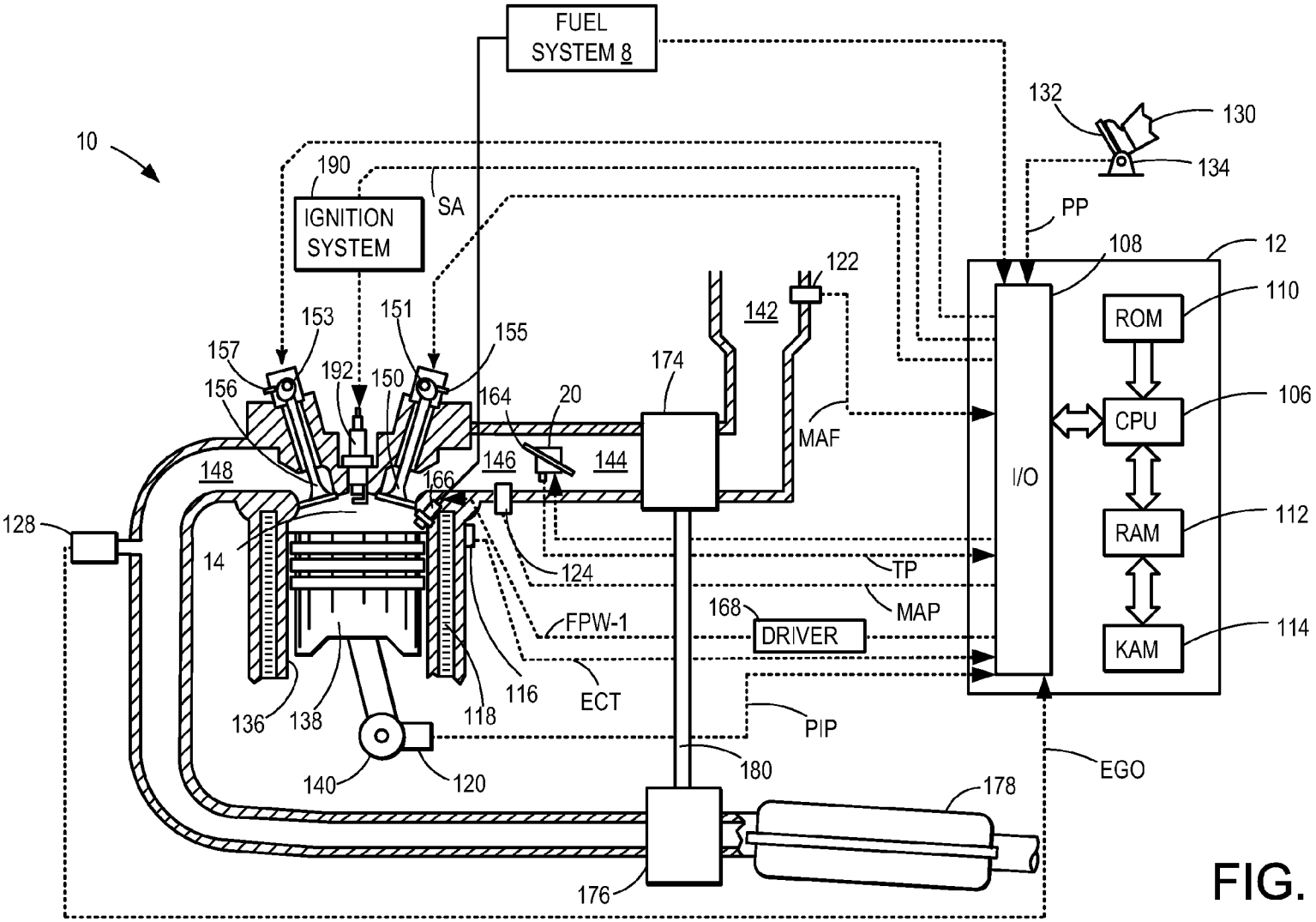
FIG. 1 shows a schematic diagram of one cylinder of an example engine system.
Figure 2A:
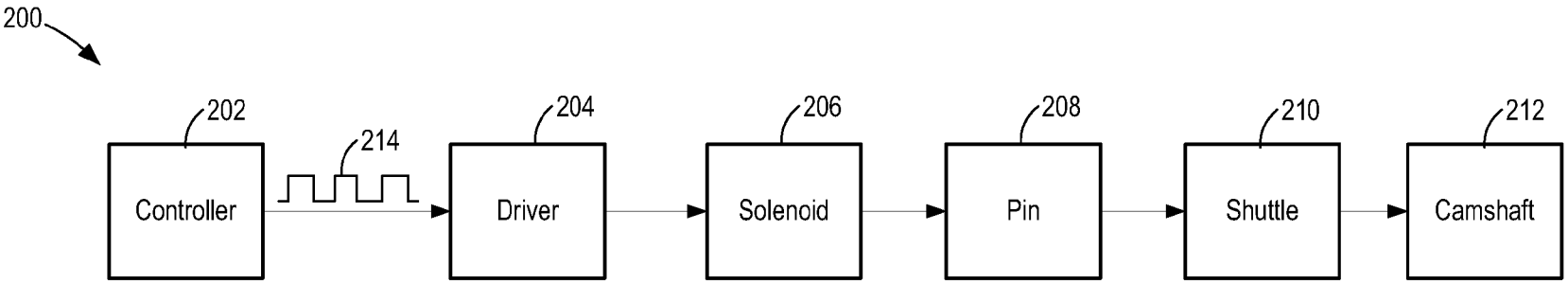
FIG. 2A shows a schematic diagram of an engine cam profile switching system with electrically-actuated cams.
Figure 2B:
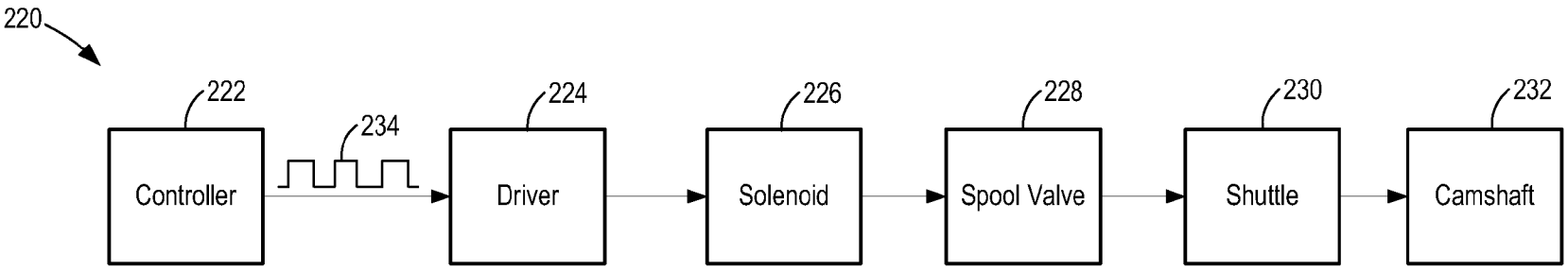
FIG. 2B shows a schematic diagram of an engine cam profile switching system with hydraulically-actuated cams.
Figure 3:
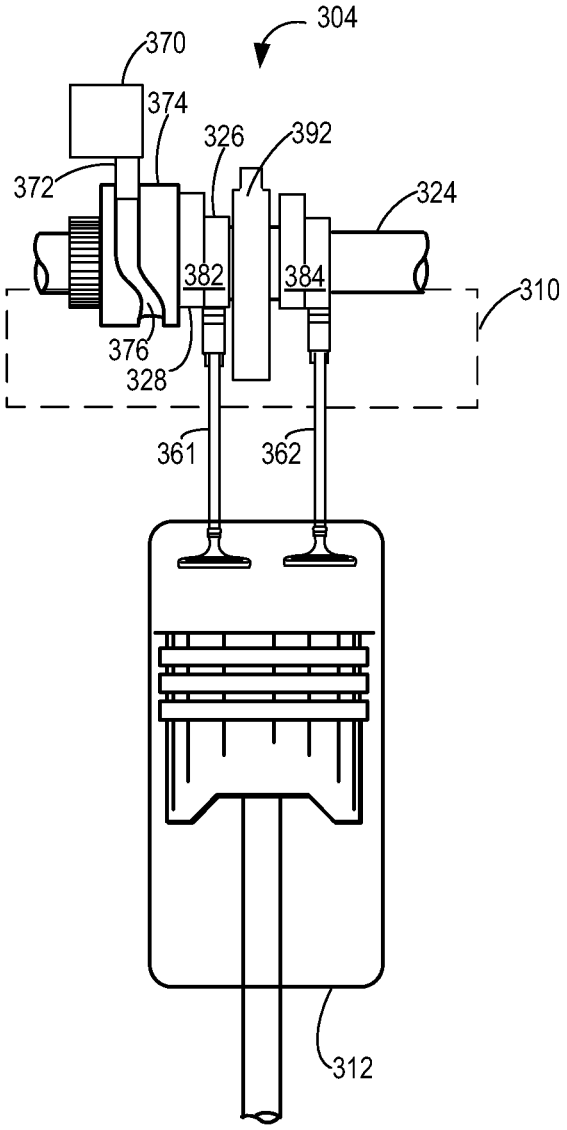
FIG. 3 shows a schematic diagram of one cylinder of an engine system along with corresponding components of a cam profile switching system.
Figure 5:
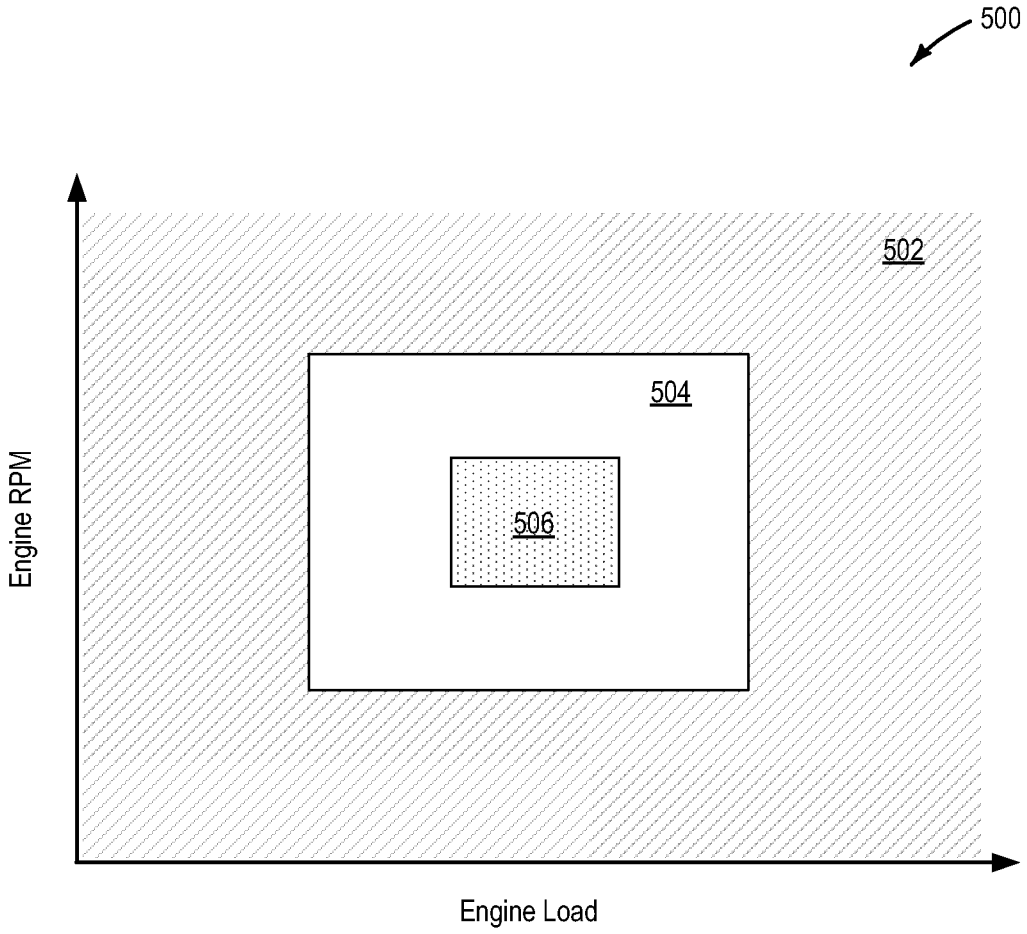
FIG. 5 shows a graph illustrating three example engine operating regions based on engine RPM and engine load.
Figure 6:
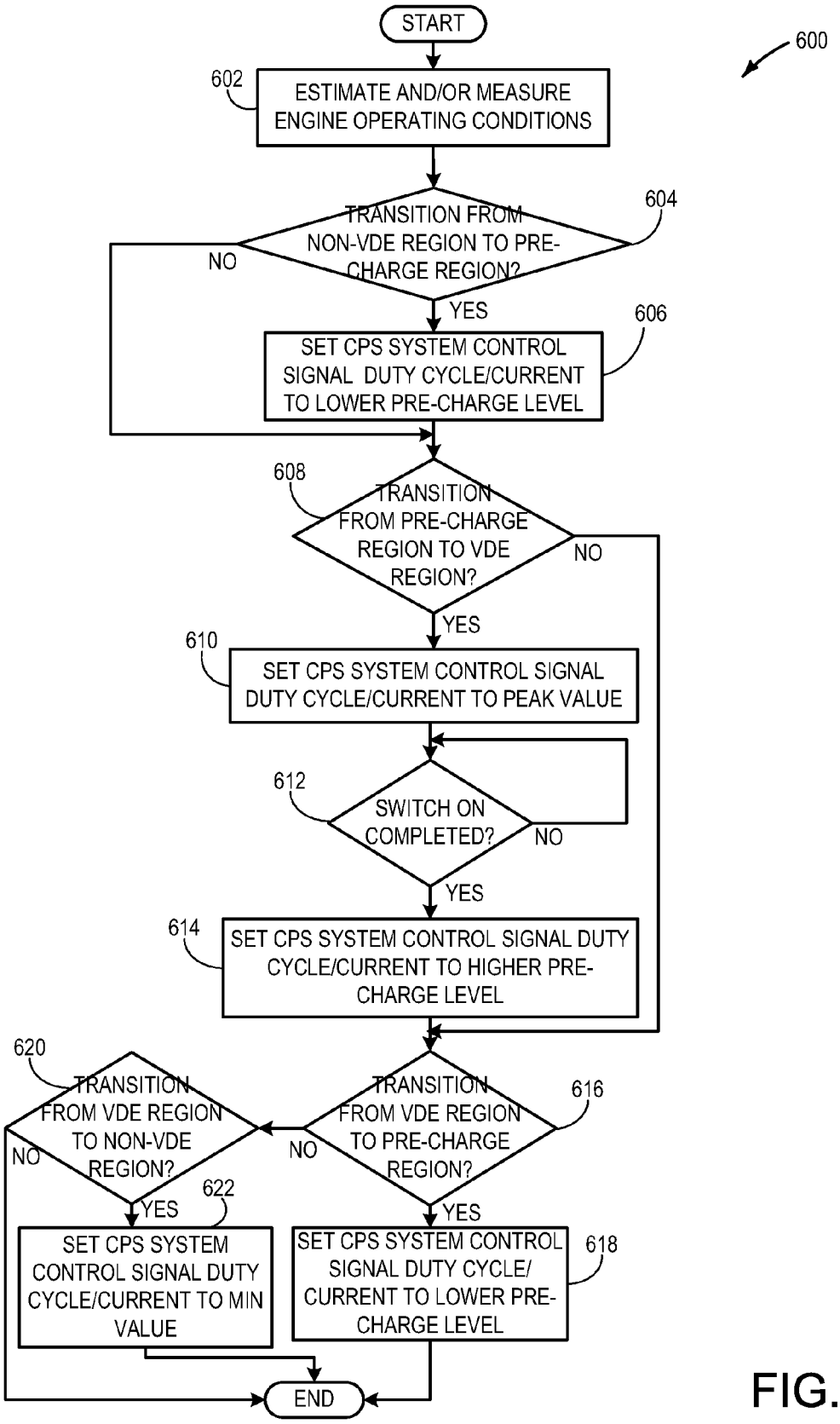
FIG. 6 shows an example method for operating a cam profile switching system in accordance with the disclosure.

The following description relates to an internal combustion engine, such as the engine shown in FIG. 1, having a cylinder bank and cylinder head enabled with a cam-profile-switching (CPS) system and variable-displacement engine (VDE) modes. As shown in FIGS. 2A and 2B, a controller may send a signal to an electrically or hydraulically actuated solenoid, and the solenoid may control a pin or spool valve to activate or deactivate one or more engine cylinders based on engine operating conditions. As shown in FIG. 3, the CPS system may include a lift cam and a no-lift cam; depending on a position of a shuttle, the position of the shuttle controlled by the solenoid, either the lift cam (resulting in cylinder activation) or the no-lift cam (resulting in cylinder deactivation) may be arranged above each intake and exhaust valve. As depicted in the timing diagrams of FIG. 4, duty cycle and/or current of a CPS system control signal may be varied based on an engine operating region (e.g., whether the engine is operating in the non-VDE region, the pre-charge region, or the VDE region based on engine speed and load as illustrated in FIG. 5). As detailed herein, varying duty cycle and/or current of a CPS system control signal may advantageously result in expedited switching between VDE and non-VDE modes. As shown in FIG. 6, in one example, the CPS system control signal duty cycle/current may be set to a lower pre-charge level when the engine is operating in the pre-charge region, a peak level when the engine enters the VDE region, a higher pre-charge level once solenoid switching is completed during operation in the VDE region, and a minimum level during operation in the non-VDE region.

Turning now to the figures, FIG. 1 depicts an example embodiment of a combustion chamber or cylinder of internal combustion engine 10. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber') 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 may communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 20 including a throttle plate 164 may be provided along an intake passage of the engine for varying the flow rate and/or pressure of intake air provided to the engine cylinders. For example, throttle 20 may be disposed downstream of compressor 174 as shown in FIG. 1, or alternatively may be provided upstream of compressor 174.

Exhaust passage 148 may receive exhaust gases from other cylinders of engine 10 in addition to cylinder 14. Exhaust gas sensor 128 is shown coupled to exhaust passage 148 upstream of emission control device 178 although in some embodiments, exhaust gas sensor 128 may be positioned downstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Exhaust temperature may be measured by one or more temperature sensors (not shown) located in exhaust passage 148. Alternatively, exhaust temperature may be inferred based on engine operating conditions such as speed, load, air-fuel ratio (AFR), spark retard, etc. Further, exhaust temperature may be computed by one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The operation of intake valve 150 and exhaust valve 156 may be determined by valve position sensors (not shown) and/or camshaft position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system. Example cam actuation systems are described in more detail below with regard to FIGS. 2 and 3.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some embodiments, each cylinder of engine 10 may be configured with one or more fuel injectors for delivering fuel. As a non-limiting example, cylinder 14 is shown including one fuel injector 166. Fuel injector 166 is shown coupled directly to cylinder 14 for injecting fuel directly therein in proportion to the pulse width of signal FPW received from controller 12 via electronic driver 168. In this manner, fuel injector 166 provides what is known as direct injection (hereafter also referred to as "DI") of fuel into combustion cylinder 14. While FIG. 1 shows injector 166 as a side injector, it may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a high pressure fuel system 8 including fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the fuel tanks may have a pressure transducer providing a signal to controller 12.

It will be appreciated that, in an alternate embodiment, injector 166 may be a port injector providing fuel into the intake port upstream of cylinder 14. Further, while the example embodiment shows fuel injected to the cylinder via a single injector, the engine may alternatively be operated by injecting fuel via multiple injectors, such as one direct injector and one port injector. In such a configuration, the controller may vary a relative amount of injection from each injector.

Fuel may be delivered by the injector to the cylinder during a single cycle of the cylinder. Further, the distribution and/or relative amount of fuel or knock control fluid delivered from the injector may vary with operating conditions, such as air charge temperature, as described herein below. Furthermore, for a single combustion event, multiple injections of the delivered fuel may be performed per cycle. The multiple injections may be performed during the compression stroke, intake stroke, or any appropriate combination thereof. It should be understood that the head packaging configurations and methods described herein may be used in engines with any suitable fuel delivery mechanisms or systems, e.g., in carbureted engines or other engines with other fuel delivery systems.

As described above, FIG. 1 shows only one cylinder of a multi-cylinder engine. As such each cylinder may similarly include its own set of intake/exhaust valves, fuel injector(s), spark plug, etc. Any number of cylinders and a variety of different cylinder configurations may be included in engine 10, e.g., V-6, I-4, I-6, V-12, opposed 4, and other engine types.

FIG. 2A schematically shows an electrically-actuated cam profile switching (CPS) system 200. As will be detailed herein, CPS system 200 may control cam profiles, and thereby control activation/deactivation of engine cylinders.

CPS system 200 includes a controller 202, which may correspond to controller 12 of FIG. 1. Controller 212 may send a pulse width modulated CPS system control signal 214 to a driver 204. Driver 204 processes the signal and sends the processed signal to a solenoid 206. Solenoid 206 may be an electromechanical actuator which controls the movement of a pin 208 in a groove of a shuttle 210 (e.g., groove 376 which will be described below with respect to FIG. 3). Shuttle 210 may be physically coupled with a camshaft 212, such that movement of pin 208 in the groove of the shuttle effects rotation of the camshaft. As will be detailed below with respect to FIG. 3, due to the curvature of the groove, movement of the pin in the groove may modify a cam lift profile, e.g. resulting in activation or deactivation of one or more engine cylinders. For example, movement of the pin in the groove may effect rotation of the crankshaft, while also causing the shuttle to move along the camshaft axially. The axial movement of the shuttle along the crankshaft may change the cam lift profile by moving a current cam away from an intake or exhaust valve and moving another cam to communicate with the valve (depending on the angle of rotation of the camshaft).

It should be appreciated that the above example shows a system by which actuation is achieved using a PWM signal, which is electrically amplified by a power driver. In this way, it is possible to control actuation force electromechanically via a solenoid to subsequently generate quicker pin or spool valve moment. The magnitude of electromechanical force generated by this mechanism can vary primarily due to electrical system voltage (battery state of charge) as well as solenoid impedance (varies in accordance with solenoid temperature). While the above approach is one example, various others are contemplated herein. For example, the method is applicable to a cam profile switching force control signal, whether it is current controlled, PWM-controlled, or otherwise controlled. The cam profile switching control signal need not correspond to a fixed frequency or duty cycle signal, or a computed & controller-commanded frequency or duty cycle signal. For example, consider a constant current device driver, which may be used in one example. The circuitry varies the frequency and duty cycle for the purpose of maintaining a fixed solenoid force (the present application includes four discrete levels of force), while the environmental conditions vary (electrical system voltage, battery state of charge, solenoid impedance (proportional with its temperature), driver circuit power efficiency (inversely proportional to its temperature), etc). Also, a DC/DC converter circuit may be used to boost the voltage available to the device drivers in order to provide more power temporarily.

FIG. 2B schematically shows a hydraulically-actuated cam profile switching (CPS) system 220. Similar to CPS system 200, CPS system 220 may control cam profiles, and thereby control activation/deactivation of engine cylinders. However, unlike CPS system 200, CPS system 220 may include a hydraulic actuator, such as a spool valve 228 in place of a pin.

Like CPS system 200, CPS system 220 includes a controller 222, which may correspond to controller 12 of FIG. 1. Controller 212 may send a pulse width modulated CPS system control signal 234 to a driver 224. Driver 224 processes the signal and sends the processed signal to a solenoid 226. Solenoid 226 may be an electro-hydraulic actuator which controls a spool valve 228, the spool valve communicating with a groove of a shuttle 230 (e.g., groove 376 which will be described below with respect to FIG. 3). Shuttle 230 may be physically coupled with a camshaft 232, such that contact between the spool valve and the groove of the shuttle effects rotation of the camshaft. As will be detailed below with respect to FIG. 3, due to the curvature of the groove, this action may modify a cam lift profile, e.g. resulting in activation or deactivation of one or more engine cylinders.

The electro-hydraulic actuator may be operated via the driver at multiple levels to control a cylinder valve mechanism, such as a cylinder valve deactivation/activation mechanism, a cam profile switching mechanism, or other valve adjustment mechanisms. For example, the driver may be operated at a first, lower level without a valve transition, and in response to an increased potential for a valve transition, the driver may be operated at a second mid level without valve transition. Further, the driver may be operated at a third, higher level inducing a valve transition in response to a valve transition request. The increased potential may be partially based on an operator command, and may include, for example, increased engine temperature above a threshold level at which valve transitions are enabled, or engine operating within a threshold of a valve transition operating condition, where the valve transitions may be cam profile switching transitions and/or valve deactivation (e.g., VDE) transitions. Engine operating conditions and valve transitions will be described in more detail below with respect to FIGS. 4-6.

FIG. 3 shows a side view of a cylinder 312. Like cylinder 14 of FIG. 1, cylinder 312 may be one of a plurality of cylinders included in an engine such as engine 10 described above. A partial view of a cam profile switching (CPS) system 304 is also shown in FIG. 3. CPS system 304 may activate or deactivate each engine cylinder 312 depending on engine operating conditions. For example, as described in more detail below, by adjusting cylinder cam mechanisms, the valves on one or more cylinders 312 may be operated with or without valve lift based on engine operating conditions. In other examples, the cylinders may be operable in multiple different valve lift modes, e.g., a high valve lift, low valve lift, and zero valve lift, rather than being activated or deactivated.

Each cylinder 312 may include a spark plug and a fuel injector for delivering fuel directly to the combustion chamber, as described above in FIG. 1. However, in alternate embodiments, each cylinder 312 may not include a spark plug and/or direct fuel injector.

Cylinders 312 may each be serviced by one or more gas exchange valves. In the present example, each cylinder 312 includes two intake valves and two exhaust valves; in the side view shown in FIG. 3, however, only the two exhaust valves 361 and 362 of cylinder 312 are visible. Each intake and exhaust valve is configured to open and close an intake port and exhaust port of cylinder 312, respectively.

In order to permit deactivation of select intake and exhaust valves, e.g., for the purpose of saving fuel, each valve in each cylinder includes a mechanism coupled to a camshaft above the valve for adjusting an amount of valve lift for that valve and/or for deactivating that valve. For example, cylinder 312 includes mechanisms 382 and 384 coupled to an exhaust camshaft 324 above exhaust valves 361 and 362, respectively, as well as mechanisms coupled to an intake camshaft above intake valves of cylinder 312 (not visible in the side view shown in FIG. 3). In the example depicted in FIG. 3, each of mechanisms 382 and 384 includes two different lift profile cams: no-lift cam 326 and lift cam 328. However, it will be understood that the mechanisms may include addition lift profiles without departing from the scope of this disclosure (e.g., a high lift cam, a low lift cam, and a no-lift cam).

CPS system 304 may control the intake and exhaust camshafts to activate and deactivate engine cylinders via contact between a pin 372 coupled with a solenoid 370 and a shuttle 374. As shown, a snaking groove 376 may traverse a circumference of the shuttle, such that movement of the pin in the groove may effect axial movement of the shuttle along the camshaft. That is, CPS system 304 may be configured to translate specific portions of the camshaft longitudinally, thereby causing operation of cylinder valves to vary between cams 326 and 328 and/or other cams. In this way, CPS system 304 may switch between multiple cam profiles. While not shown, in hydraulic embodiments, a spool valve rather than a pin may physically communicate with the shuttle to effect axial movement of the shuttle. As such, a hydraulic solenoid valve may be coupled in a hydraulic circuit of an engine, which may be further coupled to a cylinder valve actuator.

CPS system 304 may actuate each exhaust valve between an open position allowing exhaust gas out of the corresponding cylinder and a closed position substantially retaining gas within the corresponding cylinder via exhaust camshaft 324. Exhaust camshaft 324 includes a plurality of exhaust cams configured to control the opening and closing of the exhaust valves. Each exhaust valve may be controlled by no-lift cams 326 and lift cams 328, depending on engine operating conditions. In the present example, no-lift cams 326 have a no-lift cam lobe profile for deactivating their respective cylinders based on engine operating conditions. Further, in the present example, lift cams 328 have a lift cam lobe profile which is larger than the no-lift cam lobe profile, for opening the intake or exhaust valve.

Similarly, each intake valve is actuatable between an open position allowing intake air into a respective cylinder and a closed position substantially blocking intake air from the respective cylinder via an intake camshaft (not visible in the side view of FIG. 3). The intake camshaft is positioned in an overhead position above cylinders 312, parallel to exhaust camshaft 324. Like exhaust camshaft 324, the intake camshaft includes a plurality of intake cams configured to control the opening and closing of the intake valves.

The cam mechanisms may be positioned directly above a corresponding valve in cylinder 312. Further, the cam lobes may be slideably attached to the cam shaft so that they can slide along the camshaft on a per-cylinder basis. For example, FIG. 3 shows an example where the no-lift cams 326 are positioned above each valve in the cylinder. The sets of cam lobes positioned above each cylinder valve may be slid across the camshaft to change a lobe profile coupled to the valve follower mechanisms to change the valve opening and closing durations. For example, mechanism 382 positioned above valve 361 may be shifted to move lift cam 328 to a position above the valve 361 so that the lift profile associated with lift cam 328 is used to control the opening and closing of valve 361.

Cam towers, e.g., cam tower 392 shown in FIG. 3, may be coupled to a cylinder head 310 of the engine. However, though FIG. 3 shows cam tower 392 coupled to the cylinder head, in other examples, the cam towers may be coupled to other components of an engine block, e.g., to a camshaft carrier or a cam cover. The cam towers may support the overhead camshafts and may separate the mechanisms positioned on the camshafts above each cylinder.

Additional elements not shown in FIG. 3 may include push rods, rocker arms, tappets, etc. Such devices and features may control actuation of the intake valves and the exhaust valves by converting rotational motion of the cams into translational motion of the valves. In other examples, the valves can be actuated via additional cam lobe profiles on the camshafts, where the cam lobe profiles between the different valves may provide varying cam lift height, cam duration, and/or cam timing. However, alternative camshaft (overhead and/or pushrod) arrangements could be used, if desired. Further, in some examples, cylinders 312 may each have only one exhaust valve and/or intake valve, or more than two intake and/or exhaust valves. In still other examples, exhaust valves and intake valves may be actuated by a common camshaft. In another alternate embodiment, at least one of the intake valves and/or exhaust valves may be actuated by its own independent camshaft or other device.

As remarked above, the engine may include variable valve actuation systems, for example CPS system 304. A variable valve actuation system may be configured to operate in multiple operating modes. The first operating mode may occur following a cold engine start, for example when engine temperature is below a threshold or for a given duration following an engine start. During the first mode, the variable valve actuation system may be configured to open only a subset of exhaust ports of a subset of cylinders, with all other exhaust ports closed. For example, exhaust valves of less than all (e.g., a subset) of cylinders 312 may be opened. A second operating mode may occur during standard, warmed up engine operation. During the second mode, the variable valve actuation system may be configured to open all exhaust ports of all of cylinders 312. Further, during the second mode, the variable valve actuation system may be configured to open the subset of exhaust ports of the subset of cylinders for a shorter duration than the remaining exhaust ports. A third operating mode may occur during warmed up engine operation with low engine speed and high load. During the third mode, the variable valve actuation system may be configured to keep the subset of exhaust ports of the subset of cylinders closed while opening the remaining exhaust ports, e.g., opposite of the first mode. Additionally, the variable valve actuation system may be configured to selectively open and close the intake ports in correspondence to the opening and closing of the exhaust ports during the various operating modes.

The configuration of cams described above may be used to provide control of the amount and timing of air supplied to, and exhausted from, the cylinders 312. However, other configurations may be used to enable CPS system 304 to switch valve control between two or more cams. For example, a switchable tappet or rocker arm may be used for varying valve control between two or more cams.

The valve/cam control devices and systems described above may be hydraulically powered, or electrically actuated, or combinations thereof, as described with respect to FIGS. 2A and 2B. Signal lines can send control signals to and receive a cam timing and/or cam selection measurement from CPS system 304.

As noted herein, in one example of a compression or auto-ignition capable engine, the intake valve(s) may be actuated either by a high or low lift cam profile depending on the selected combustion mode. The low lift cam profile may be used to trap a high level of residual (exhaust) gas in the cylinder. The trapped gasses promote compression or auto-ignition by increasing the initial charge temperature, in some examples. However, in a spark ignition mode (either high or low loads) the high lift cam profile may be used. Such a switchable cam profile may be achieved through various cam and tappet systems. The switching may be achieved in any suitable manner, e.g., through oil flow hydraulic actuators or using electric actuators. As another example, such systems may involve an increased number of tappets.

As used herein, active valve operation may refer to a valve opening and closing during a cycle of the cylinder, whereas deactivated valves may be held in a closed position for a cycle of the cylinder (or held in a fixed position for the cycle). It will be appreciated that the above configurations are examples and the approaches discussed herein may be applied to a variety of different variable valve lift profile systems and configurations, such as to exhaust systems, as well as systems that have more than two intake or two exhaust valves per cylinder.

Figure 4:
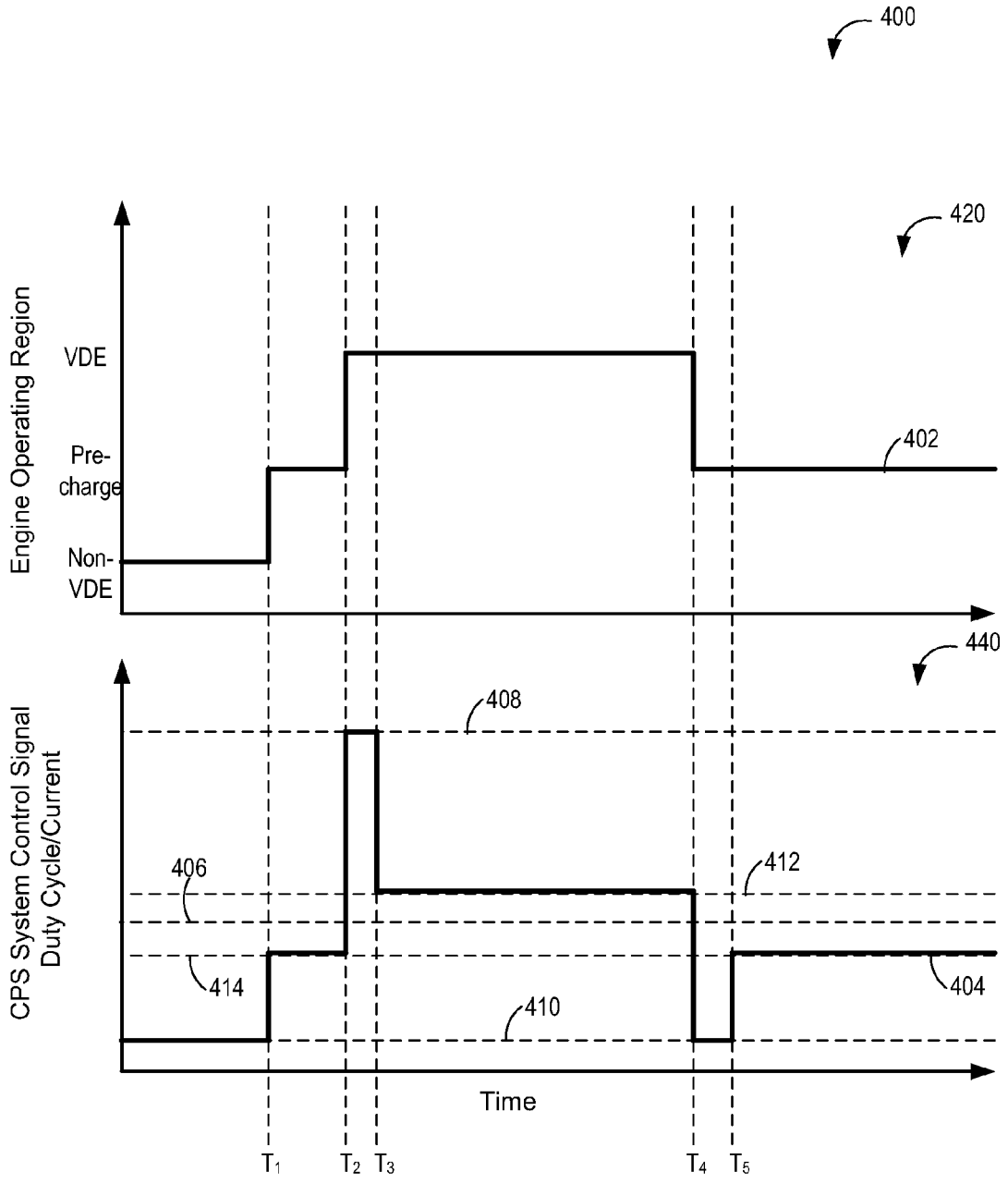
FIG. 4 depicts timing diagrams relating engine operating region with duty cycle/current of a cam profile switching system ca control signal.

FIG. 4 illustrates timing diagram 400, which relates engine operating region with duty cycle/current level of a CPS system control signal. Timing diagram 400 includes a diagram 420 showing engine operation region on the Y-axis and time on the X-axis, along with a diagram 440 showing CPS system control signal duty cycle and/or current on the Y-axis and time on the X-axis.

In diagram 420, current engine operating region is represented by characteristic 402. In the depicted example, before time T1, the engine is operating in a non-VDE operating region. As will be detailed below with respect to FIGS. 5 and 6, the non-VDE operating region may be a region corresponding to engine load and engine speed conditions which are not conducive to cylinder deactivation, for example. At this time, CPS system control signal duty cycle and/or current (referred to as "the signal" for brevity in the description of FIG. 4) may be at a minimum level 410. Minimum level 410 may be a function of engine operating conditions, e.g. battery state of charge, and thus may vary in a range upwardly bounded by a solenoid switching threshold, depending on engine operating conditions. Further, before time T1, a CPS system solenoid whose state is determined by the signal may be "off" (where an "off" solenoid denotes a solenoid state corresponding to active cylinders and cam lift, and an "on" solenoid denotes a solenoid state corresponding to one or more deactivated cylinders with no cam lift). However, at time T1, engine speed and load conditions (or other engine operating parameters) may change, for example due to driver tip-in. The changed engine operating conditions may cause the engine to transition from the non-VDE region to a pre-charge region at time T1. As will be detailed below with respect to FIGS. 5 and 6, the pre-charge region may be a region of engine operation which has an increased potential for transition of the solenoid valve between the "on" and "off" states due to an increased potential for transition into or out of a VDE operating region. Responsive to the transition into the pre-charge region from the non-VDE region, the signal may be increased to a lower pre-charge or pre-activation level 414, as shown in diagram 440. The lower pre-charge level 414 may be a level just below a switching threshold 406 (where the solenoid changes state from "off" to "on" when the signal exceeds the switching threshold, and where the solenoid changes state from "on" to "off" when the signal falls below the switching threshold). The lower pre-charge level 414 may be a function of engine operating conditions, e.g. battery state of charge, and thus may vary in a range bounded by the minimum level and the switching threshold, depending on engine operating conditions.

At time T2, the engine operating region transitions from the pre-charge region to the VDE region (e.g., due to changes in engine speed and/or load). Responsive to this change, the signal is increased to a maximum level 408, as shown in diagram 440. Increasing the signal to a maximum level 408 may advantageously reduce the switching time of the solenoid controlled by the signal. Maximum level 408 may be a function of engine operating conditions, e.g. battery state of charge, and thus may vary in a range with a lower bound corresponding to the solenoid switching threshold, depending on engine operating conditions. After a duration, at time T3, the solenoid switches "on" and the signal is reduced to a higher pre-charge or pre-activation level 412. This duration may vary based on engine operating conditions, e.g. based on a battery state of charge.

Higher pre-charge level 412 may be lower than the maximum level, but higher than the lower pre-charge level and higher than the switching threshold. Reducing the signal from the maximum level to the higher pre-charge threshold once solenoid switching has occurred may advantageously improve energy efficiency while ensuring that the solenoid remains in the "on" state during engine operation in the VDE region. Accordingly, whereas the signal may not transition from the minimum level to the lower pre-charge level until the engine enters the pre-charge region from the non-VDE region, the signal may transition from the maximum level to the higher pre-charge level while the engine is still operating in the VDE region (after the solenoid has been switched "on"). Such operation may provide further expedition of solenoid state switching, while also providing energy efficiency benefits.

At time T4, due to a change in engine operating conditions (e.g., a change in engine speed and/or load), the engine operating region may transition from the VDE region to the pre-charge region, and the engine may continue to operate in the pre-charge region until after time T5, as shown in diagram 420. Responsive to this change, the signal may be reduced from the higher pre-charge level 412 to the minimum level 410 for a duration, to expedite switching of the solenoid from the "on" state to the "off" state. This duration may vary based on engine operating conditions, e.g. based on a battery state of charge. After the duration, the signal may be increased to the lower pre-charge level, as operation in the pre-charge region increases the likelihood of a transition into the VDE region, and the benefits of ensuring rapid solenoid switching upon transitioning into the VDE region may outweigh any disadvantages associated with increasing the signal from the minimum level (e.g. increased power dissipation relative to maintaining the signal at the minimum level).

It will be appreciated that timing diagram 400 depicts adjustments to CPS control signal duty cycle and/or current based on engine operating region during just one example interval and throughout just one example sequence of engine operating region transitions. Many other sequences of engine operating region transitions and corresponding CPS system control signal duty cycle and/or current adjustments may be used without departing from the scope of this disclosure.

FIG. 5 shows a graph 500 illustrating three example engine operating regions based on engine RPM and engine load. The X-axis represents engine load, which may correspond to measured engine load or requested engine torque, for example. The Y-axis represents engine RPM, which may correspond to measured engine speed/RPM, for example.

A non-VDE engine operating region is shown at 502. In the example of FIG. 5, the non-VDE engine operating region corresponds to low engine RPM and low engine load conditions, high engine RPM conditions, low engine RPM conditions, and high engine RPM and high engine load conditions. In other examples, however, the non-VDE region may correspond to other engine speed and load combinations, or may be determined based on other engine operating parameters. During operation in the non-VDE region, the CPS system solenoid may be controlled such that lift cam profiles are used for the engine cylinder valves to activate the cylinders, for example. In other words, in response to an engine operating in a non-VDE condition, the actuator may be set to an inactive state by setting a low current level in a driver circuit.

A pre-charge operating region is shown at 504. During the engine pre-charge operating condition, the CPS system solenoid may be set to a pre-activation state by setting a mid current level in the driver circuit, which may be more activated than the inactive state. Further, the pre-charge operating condition may be at a higher temperature than the first engine operating condition. In the example of FIG. 5, the pre-charge operating region corresponds approximately to medium engine RPM and medium engine load conditions. In other examples, however, the pre-charge region may correspond to other engine speed and load combinations, or may be determined based on other engine operating parameters. It will be understood that the pre-charge region is a region between the non-VDE region and the VDE region which will be described below. For example, the engine may operate in the pre-charge region when engine speed and load are changing towards the VDE region. However, the engine may also transition back and forth between the non-VDE region and the pre-charge without entering the VDE region, or may transition back and forth between the VDE region and the pre-charge region without entering the non-VDE region during certain conditions. Further, during conditions where engine speed and load (or other engine operating parameters) change rapidly, the engine may transition from the non-VDE region directly to the VDE region, or from the VDE region directly to the non-VDE region. When engine operation enters the pre-charge region, the CPS system control signal may be increased from a minimum duty cycle and/or current, or decreased from a maximum duty cycle and/or current, or it may remain unchanged, e.g. depending on a state of the solenoid and a previous operating region as described with respect to FIGS. 4 and 6.

A VDE operating region is shown at 506. In the example of FIG. 5, the VDE operating region corresponds approximately to medium engine RPM and medium engine load conditions, in a smaller range from the center of the graph than the range of medium engine speed and load values included in pre-charge region 504. In other examples, however, the VDE region may correspond to other engine speed and load combinations, or may be determined based on other engine operating parameters. The VDE region may be a region of engine operation in which cylinder deactivation (VDE operation) is advantageous, for example during conditions where decreased engine output is required and cylinder deactivation will improve fuel efficiency without negatively affecting engine performance. When engine operation enters the VDE region, the CPS system control signal may be increased to a maximum duty cycle and/or current, either from a lower pre-charge level if transitioning from pre-charge region operation, or from a minimum level if transitioning directly from non-VDE region operation, as described with respect to FIGS. 4 and 6. During operation in the VDE region, the CPS system solenoid may be set to an activation state and controlled such that no-lift cam profiles are used for one or more engine cylinder valves, to deactivate the cylinders.

It will be appreciated that graph 500 is one non-limiting example of engine operating regions. In other examples, engine operating regions other than the three depicted in graph 500 may be used. Alternatively, each of the non-VDE, pre-charge, and VDE regions may be shaped differently, smaller or larger, etc. without departing from the scope of this disclosure.

FIG. 6 shows an example method 600 for operating a CPS system such as CPS system 304 shown in FIG. 3. In particular, method 600 describes setting a CPS system control signal duty cycle and/or current based on engine operating region, where the VDE duty cycle and/or current determines the switching state of an electromechanical actuator such as a solenoid to actuate a CPS mechanism that operates as a cylinder deactivation/activation mechanism, and where the solenoid controls camshaft position (and thus controls the cam lift profiles of cylinder valves) in order to operate engine cylinders with or without VDE. The CPS system may include multiple cam profiles. In one example, a cam profile may be a cylinder deactivation profile. During a non-VDE state of engine operation, the actuator may be operated at a first level without a cam profile transition. At 602, method 600 includes estimating and/or measuring engine operating conditions. These may include, for example, engine speed (RPM), rate of change of engine speed, engine load/desired torque (for example, from a pedal-position sensor), manifold pressure (MAP), manifold air flow (MAF), BP, engine temperature, catalyst temperature, intake temperature, spark timing, boost level, air temperature, knock limits, etc.

At 604, method 600 includes determining whether engine operation is transitioning from a non-VDE region (e.g., non-VDE region 502 of FIG. 5) to a pre-charge region (e.g., pre-charge region 504 of FIG. 5). For example, the controller may determine a region of operation of the engine based on the estimated and/or measured engine operating conditions, such as engine speed and load. As shown in FIG. 5, a non-VDE region of operation may surround a pre-charge region, and the pre-charge region may surround a VDE region of operation. As such, a transition in engine operation from the non-VDE region to the pre-charge region may be an indicator that VDE operation is imminent, and thus that pre-charging may be needed to ensure expeditious solenoid switching in the case of a transition to VDE operation.

If the answer at 604 is NO, method 600 proceeds to step 608, which will be described below. Otherwise, if the answer at 604 is YES, method 600 proceeds to 606. At 606, method 600 includes setting CPS system control signal duty cycle and/or current to a lower pre-charge level (e.g., level 414 in the example of FIG. 4). For example, if the engine is transitioning from the non-VDE region to the pre-charge region, engine speed and/or load may be increasing or decreasing towards the pre-charge region and thus conditions appropriate for VDE operation may be imminent indicating an increased potential for valve transition. Therefore, in response to the increased potential for valve transition, the actuator may be operated at a second level, which may be higher than the first level. The increase in potential for valve transition may be based on increased or decreased depression of an accelerator pedal by an operator. Accordingly, by setting the VDE duty cycle and/or current to the lower pre-charge level at this time, duty cycle and/or current may be closer to a switching threshold (e.g., switching threshold 406 of FIG. 4) when it is time to switch to VDE operation, and thus switching may be completed more quickly relative to switching speed when switching from a minimum CPS system control signal duty cycle and/or current value to a value above the switching threshold.

After 606, or if the answer at 604 is NO, method 600 proceeds to 608. At 608, method 600 includes determining whether engine operation is transitioning from the pre-charge region to a VDE region (e.g., VDE region 506 of FIG. 5). As described above for step 604, the controller may determine a region of operation of the engine based on the estimated and/or measured engine operating conditions, such as engine speed and load.

If the answer at 608 is NO, method 600 proceeds to step 616, which will be described below. Otherwise, if the answer at 608 is YES, method 600 proceeds to 610. At 610, method 600 includes setting the CPS system control signal duty cycle and/or current to a peak level. For example, the peak level may correspond to a duty cycle and/or current value greater than a solenoid switching threshold, such as level 408 shown in FIG. 4. Setting the control signal duty cycle and/or current to the peak level when transitioning from the pre-charge region to the VDE region may provide the quickest solenoid switching (e.g., the quickest transition to a level of magnetic force which will switch the state of the solenoid). In other words, to induce a valve transition, the actuator may be operated at a third level, which may be higher than the first and second levels.

After 610, method 600 proceeds to 612. At 612, method 600 includes determining whether solenoid switching is completed. The determination may be made based on measurement of current at the solenoid, in one non-limiting example. If solenoid switching is not completed, the solenoid has not yet controlled a pin, spool valve, or other actuator coupled with the shuttle and camshaft, and thus a cam lift profile for non-VDE operation (e.g., a lift cam profile) may still be used. For example, if solenoid switching is not completed, one or more cylinder valves may be in contact with a lift cam such as cam 328 of FIG. 3, whereas one or more cylinder valves may be in contact with a no-lift cam such as cam 326 of FIG. 3 if solenoid switching is completed.

If the answer at 612 is NO, method 600 continues checking whether solenoid switching is completed (e.g., by executing a routine for the determination at predetermined intervals or on an interrupt basis). Otherwise, if the answer at 612 is YES indicating that the solenoid state has switched, and thus that a cam lift profile appropriate for VDE operation (e.g., a no-lift cam profile) may be in use, method 600 proceeds to 614. At 614, method 600 includes setting the CPS system control signal duty cycle and/or current to a higher pre-charge level. In order to maintain the valve transition after operating the actuator at a third level, the actuator may be operated at a fourth level, for example, at the higher pre-charge level, which may correspond to a duty cycle and/or current value slightly larger than a solenoid switching threshold, such as level 412 shown in FIG. 4. In other words, the fourth level may be lower than the third level but higher than the first and second levels. Setting the control signal duty cycle and/or current to the higher pre-charge level after the solenoid switches, and during VDE operation, may advantageously reduce power consumption while ensuring that the solenoid switching state does not change.

After 614, method 600 proceeds to 616. At 616, method 600 includes determining whether engine operation is transitioning from the VDE region to the pre-charge region. As described above for step 604, the controller may determine a region of operation of the engine based on the estimated and/or measured engine operating conditions, such as engine speed and load.

If the answer at 616 is YES, method 600 proceeds to 618. At 618, method 600 includes setting the CPS system control signal duty cycle and/or current to a minimum level. For example, the minimum level may correspond to a duty cycle and/or current value smaller than the solenoid switching threshold, such as level 410 shown in FIG. 4, and may be a minimum acceptable duty cycle and/or current level for the CPS system control signal. Therefore, in response to an increased potential for a second valve transition, the actuator may be operated at a fifth level to return the engine operation to a non-VDE state. Setting the CPS system control signal duty cycle and/or current to the minimum level when transitioning from VDE operation to operation in the pre-charge region may advantageously reduce power consumption, while ensuring that the solenoid switching state does not change.

Otherwise, if the answer at 616 is NO, method 600 proceeds to 620. At 620, method 600 includes determining whether engine operation is transitioning from the VDE region to the non-VDE region. As described above for step 604, the controller may determine a region of operation of the engine based on the estimated and/or measured engine operating conditions, such as engine speed and load. While less frequent than transitions from the VDE region to the pre-charge region, transitions from the VDE region to the non-VDE region may occur during engine operating conditions such as sudden braking, rapid acceleration, etc.

If the answer at 620 is NO, method 600 ends. Otherwise, if the answer at 620 is YES, method 600 proceeds to 622. At 622, method 600 includes setting the CPS system control signal duty cycle and/or current to a minimum level. For example, the minimum level may correspond to a duty cycle and/or current value smaller than the solenoid switching threshold, such as level 410 shown in FIG. 4, and may be a minimum acceptable duty cycle and/or current level for the CPS system control signal. Setting the control signal duty cycle and/or current to the minimum level when transitioning from VDE operation to operation in the non-VDE region may advantageously expedite switching of the solenoid state to a state appropriate for non-VDE operation, while reducing power consumption. After 622, method 600 ends with the engine operating with all cylinders firing (e.g., in non-VDE mode).

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine method, comprising:

adjusting an electromechanical actuator to slide cam-lobes across a camshaft to change cylinder valve opening durations, including operating the actuator at a first energization level without a valve transition, operating the actuator at a second energization level without a valve transition in response to an increased potential for a valve transition, and operating the actuator at a third energization level inducing a valve transition, the second energization level being between the first and third energization levels.

2. The method of claim 1, wherein the second energization level is higher than the first energization level, wherein the potential for the valve transition is increased based on increased or decreased depression by an operator of an accelerator pedal, and wherein the energization levels comprise duty cycles delivered to the actuator by a controller.

3. The method of claim 2, wherein the increased potential for a valve transition further includes the engine operating at a lower load than when the actuator was at the first energization level, wherein the cylinder valve opening durations include a first profile with valve lift duration, and a second profile with no lift, and wherein the energization levels further comprise current levels delivered to the actuator by the controller.

4. The method of claim 1, wherein the method further comprises operating the actuator at a fourth energization level maintaining the valve transition after operating the actuator at the third energization level, the fourth energization level lower than the third energization level, but higher than the first and second energization levels.

5. The method of claim 4, wherein operating at the second energization level immediately follows operating at the first energization level, and operating at the third energization level immediately follows operating at the second energization level, and operating at the fourth energization level immediately follows operating at the third energization level.

6. The method of claim 4, wherein engine operation is in a non-VDE state during operation of the actuator at the first and second energization levels, and in a VDE state during operation of the actuator at the third and fourth energization levels, and wherein operating the actuator at the fourth energization level is responsive to completion of the valve transition.

7. The method of claim 6, further comprising operating the actuator at a fifth energization level to return the engine operation to the non-VDE state in response to an increased potential for a second valve transition.

8. The method of claim 7, wherein the fifth energization level is lower than the second energization level.

9. An engine method, comprising:

in response to a first engine operating condition, setting a cylinder valve actuator to an inactive state;

in response to a second engine operating condition, setting the actuator to a pre-activation state more activated than the inactive state; and in response to a third engine operating condition, setting the actuator to an activation state more activated than the pre-activation state;

wherein the inactive state, the pre-activation state, and the activation state each comprise different energization levels of the actuator.

10. The method of claim 9, wherein the second engine operating condition is at a lower load than the first engine operating condition.

11. The method of claim 10, wherein the third engine operating condition is at a lower load than the second engine operating condition.

12. The method of claim 9, wherein the second engine operating condition is at a higher temperature than the first engine operating condition, wherein the inactive state comprises a minimum energization level of the actuator, and wherein the activation state comprises a maximum energization level of the actuator.

13. The method of claim 9, wherein the actuator is a cylinder valve deactivation actuator, and wherein the energization levels comprise duty cycles delivered to the actuator by a controller.

14. The method of claim 9, wherein the actuator is a hydraulic solenoid valve coupled in a hydraulic circuit of the engine, and wherein the energization levels comprise current levels delivered to the actuator by a controller.

15. The method of claim 9, wherein setting the actuator to the inactive state includes setting a relatively low current level in a driver circuit; setting the actuator to the pre-activation state includes setting a mid current level in the driver circuit; and setting the actuator to the activation state includes setting a relatively high current level in the driver circuit.

16. An engine method, comprising:

adjusting an electro-hydraulic actuator to slide cam-lobes across a camshaft to change cylinder valve opening and closing durations, including operating the actuator via a driver at a first, lower energization level without a valve transition, operating the driver at a second, middle energization level without a valve transition in response to an increased potential for a valve transition, and operating the driver at a third, higher energization level inducing a valve transition responsive to a valve transition request.

17. The method of claim 16, wherein the increased potential includes increased engine temperature above a threshold level at which valve transitions are enabled, and wherein the energization levels comprise duty cycles delivered to the actuator by the driver.

18. The method of claim 16, wherein the increased potential includes the engine operating within a threshold of a valve transition operating condition, and wherein the energization levels comprise current levels delivered to the actuator by the driver.

19. The method of claim 16, wherein the increased potential is at least partially based on an operator command, wherein the first energization level comprises a minimum energization level of the actuator, and wherein the third energization level comprises a maximum energization level of the actuator.

20. The method of claim 16, wherein the increased potential is at least partially based on vehicle operating conditions including vehicle speed and a rate of change of vehicle speed.

* * * * *